United States Patent [19]
Duncan, Jr.
[11] 4,201,817
[45] May 6, 1980

[54] DOOR MAT

[75] Inventor: Thomas P. Duncan, Jr., 601 Riverside Dr., Newport News, Va.

[73] Assignees: Thomas P. Duncan, Jr.; Frank Belvin, both of Newport News, Va.

[21] Appl. No.: 646,911

[22] Filed: Jan. 6, 1976

[51] Int. Cl.[2] ..... B32B 3/02; B32B 7/08

[52] U.S. Cl. ..... 428/141; 4/185 F; 52/181; 150/52 R; 428/157; 428/124; 428/192; 428/223; 40/10 D

[58] Field of Search ..... 52/181; 428/98, 101, 428/141, 157, 192, 542, 543, 124, 223; 4/185 F; 40/10 R, 10 D; 150/0.5, 52 R

[56] References Cited

U.S. PATENT DOCUMENTS

| | | | |
|---|---|---|---|
| 1,225,886 | 5/1917 | Strobel | 428/192 |
| 1,756,380 | 4/1930 | Osborn | 428/141 |
| 1,989,704 | 2/1935 | Leguillon | 428/141 |
| 2,258,314 | 10/1941 | Bonnell | 428/157 |
| 2,862,834 | 12/1958 | Hiler | 428/141 |
| 3,263,352 | 8/1966 | Fitzpatrick | 40/10 R |
| 3,283,421 | 11/1966 | Schott | 40/10 R |
| 3,553,864 | 1/1971 | Karlyn et al. | 40/10 D |
| 3,698,111 | 10/1972 | Smith | 40/10 R |

*Primary Examiner*—William R. Dixon, Jr.
*Attorney, Agent, or Firm*—Jacobi, Lilling & Siegel

[57] ABSTRACT

A door mat formed of a flexible, waterproof material comprising a lower section and an upper section hingedly connected to the lower section at one end thereof. In this manner, the upper section may be lifted from the lower section for the placement between the sections of a newspaper or other article. The upper section may then be lowered to cover, protect and retain the newspaper or other article between it and the lower section.

1 Claim, 2 Drawing Figures

FIG. 1
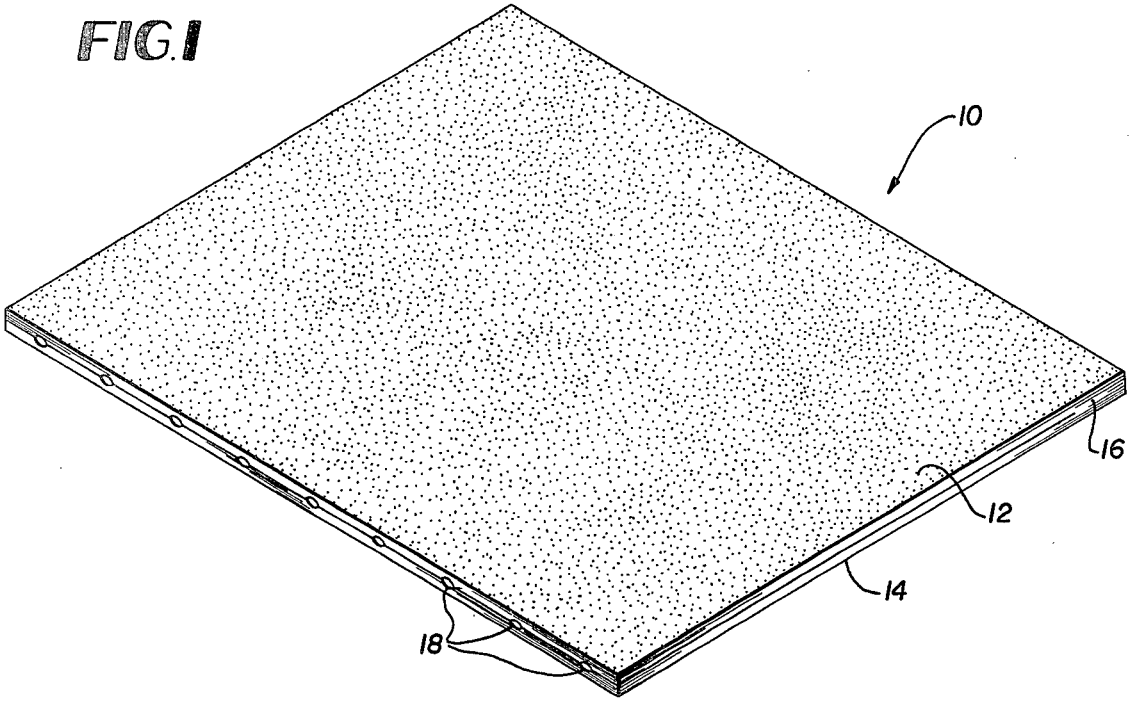
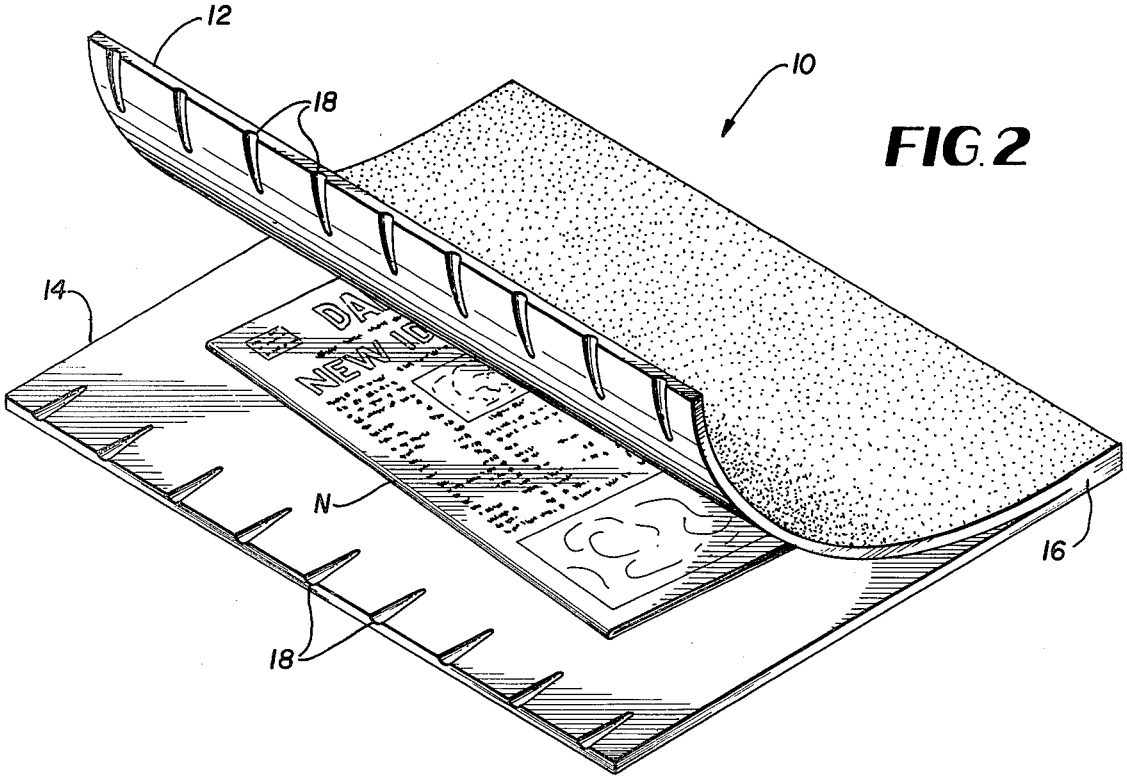
FIG. 2

DOOR MAT

BACKGROUND OF THE INVENTION

This invention relates to a door mat and, more particularly, to a door mat which is provided with separable sections for the protection and retention of newspapers and similar articles therebetween.

Heretofore, door mats have been formed as single sections with various shapes from materials such as rubber, plastic or woven materials. In substantially all cases, the conventional door mat cannot function to protect or retain newspapers or similar articles unless the door mat is lifted and the article placed on the exterior ground surface beneath the door mat. Since dirt and moisture tend to build up under exterior door mats, the newspaper or article placed on the ground beneath the door mat may become dirty or wet.

In some cases, the door mats are made from porous or open weave materials, with the result that a paper or other article placed underneath them will be exposed to moisture through the door mat in the event of rain. In other cases, door mats have been of the size that is too small or of a material that is too light in weight to fully protect a newspaper or similar article placed beneath them. It will be readily seen, therefore, that a need has arisen for a waterproof door mat that is capable of adequately protecting and retaining articles such as newspapers in a dry, clean condition.

SUMMARY OF THE INVENTION

The door mat of the present invention is formed of a waterproof material and is capable of protecting and retaining articles such as newspapers or the like in a dry, clean condition out of contact with the ground surface beneath the door mat. This is accomplished by providing the door mat with two flexible sections, a lower section and an upper section movably or hingedly connected to the lower section at one end thereof. In this manner, the upper section can be lifted and an article such as a newspaper or the like can be placed between the two sections out of contact with the ground surface beneath the door mat. Thereafter, the upper section is lowered over the article to protect and retain it between the upper and lower sections.

Preferably, the door mat of the present invention is of a size sufficient to receive and fully cover between the upper and lower sections an article such as a newspaper or the like. Also, the upper section preferably is of sufficient thickness to resist upward movement thereof by the wind or the like so as to retain and protect the article positioned between it and the lower section.

The lower section may be provided with a plurality of drain recesses in its upper surface adjacent the front-end of the door mat for the purpose of facilitating the removal of any water or moisture that may be present between the sections.

BRIEF DESCRIPTION OF THE DRAWING

FIG. 1 is a perspective view of a door mat constructed in accordance with the principles of the present invention, showing the upper section in a closed position adjacent to the lower section; and FIG. 2 is a perspective similar to FIG. 1, showing the upper section in an open position separated from the lower section.

DESCRIPTION OF THE PREFERRED EMBODEMENT

The door mat 10 of the present invention is formed of a suitable, durable, flexible, waterproof material, such as a plastic or rubber material. As illustrated in FIGS. 1 and 2, the door mat comprises an upper flat section 12 and a lower flat section 14 that are movably or hingedly connected at 16 at one end thereof. Preferably, the door mat is molded with the upper and lower sections 12 and 14 integrally formed.

As shown in FIG. 2, the upper section 12 can be lifted away from the lower section 14 for the purpose of receiving therebetween an article N such as a newspaper or the like. Thereafter, the upper section 12 is lowered to cover and retain the article N between the upper and lower sections 12 and 14. In this manner, the article N is maintained in a dry, clean condition out of contact with the ground surface beneath the door mat.

Preferably, the door mat 10 of the present invention is of a sufficient size and shape so that the upper section 12 can completely cover articles such as newspapers of average size. Also, the upper and lower sections 12 and 14 are of sufficient thickness and weight so as to resist separation by wind or the like to retain the newspaper or other article therebetween.

For the purpose of facilitating the removal of water or moisture that may accumulate between the upper and lower sections 12 and 14, the front, inner surfaces of the upper and lower sections may be provided with tapered drain openings 18. The drain openings 18 also serve to facilitate the gripping of the upper section for the purpose of separating it from the lower section.

Since the upper and lower sections 12 and 14 are of substantially identical construction, the mat 10 can conveniently be reversed when the upper surface of the upper section 12 becomes worn, thereby extending the period of usefulness of the door mat of the present invention.

If desired, the outer surfaces of the upper and lower sections 12 and 14 may be rough or textured for the purpose of resisting slipping.

What is claimed is:

1. A door mat formed of a flexible and waterproof material, comprising a lower substantially flat section and an upper substantially flat section hingedly connected adjacent one end thereof to said lower section, said upper and lower sections being of sufficient thickness and weight to resist separation when exposed to wind, said upper section being movable upwardly away from said lower section for the purpose of receiving and retaining an article therebetween, the inner surfaces of said upper and lower sections having drain openings at their front ends for the purpose of removing water or moisture accumulating between said sections.

* * * * *